US006736172B1

(12) United States Patent
Chetaille et al.

(10) Patent No.: US 6,736,172 B1
(45) Date of Patent: May 18, 2004

(54) FILLING MACHINE COMPRISING HAVING AT LEAST ONE CHAMBER ENCLOSURE WITH A CONTROLLED ATMOSPHERE

(75) Inventors: Didier Chetaille, Le Havre Cedex (FR); Rodolphe Saint-Martin, Le Havre Cedex (FR); Andrea Lupi, Le Havre Cedex (FR)

(73) Assignee: Sidel, Le Havre Cedex (FR)

( * ) Notice: Subject to any disclaimer, the term of this patent is extended or adjusted under 35 U.S.C. 154(b) by 0 days.

(21) Appl. No.: 10/069,010

(22) PCT Filed: Aug. 14, 2000

(86) PCT No.: PCT/FR00/02322

§ 371 (c)(1),
(2), (4) Date: Jul. 30, 2002

(87) PCT Pub. No.: WO01/14241

PCT Pub. Date: Mar. 1, 2001

(30) Foreign Application Priority Data

Aug. 23, 1999 (FR) ..... 99 10762

(51) Int. Cl.[7] ..... B65B 31/02

(52) U.S. Cl. ..... 141/177; 141/51; 141/145; 141/371; 141/372

(58) Field of Search ..... 141/6, 7, 39, 49, 141/51, 94, 145, 147, 177, 371, 372; 53/306, 329

(56) References Cited

U.S. PATENT DOCUMENTS 3,486,840 A 12/1969 Burton et al.
6,082,418 A * 7/2000 Naecker et al. ..... 141/145

FOREIGN PATENT DOCUMENTS

DE 718 389 C 11/1942
EP 0 727 367 A 8/1996
EP 0 965 524 A 12/1999

* cited by examiner

*Primary Examiner*—Gregory L. Huson
*Assistant Examiner*—Peter deVore
(74) *Attorney, Agent, or Firm*—Sughrue Mion, PLLC

(57) ABSTRACT

A machine for filling containers includes a series of filling stations, each of which is equipped with an impervious chamber for receiving a container to be filled. The chamber is opened in order to load or unload the container and closed in order to control the atmosphere in the chamber during the filling process. The chamber is delimited by an upper head section, which has a filling spout, by an essentially cylindrical lateral wall and by a base wall. The filling machine has element for modifying the volume of the closed chamber.

14 Claims, 6 Drawing Sheets

FILLING MACHINE COMPRISING HAVING AT LEAST ONE CHAMBER ENCLOSURE WITH A CONTROLLED ATMOSPHERE

The invention concerns machines for filling containers.

More particularly, it concerns container filling machines having at least one fill station provided with a sealed enclosure intended to receive at least one container to be filled. In this type of machine, the enclosure is opened to allow the container to be loaded or removed, and it is closed again to allow the atmosphere in the enclosure to be controlled while the container is being filled. The enclosure is delimited by a top wall into which a fill nozzle opens, an appreciably cylindrical side wall, and a bottom wall.

For example, such a machine is described in Patent Application WO-99/05061. In particular, it allows containers to be filled with products that need to be drawn off under special conditions of pressure.

In the food industry, it is known that some beverages, such as beer, must be drawn off under a pressure that is lower than the atmospheric pressure, while others, such as carbonated drinks, are preferably drawn off under a pressure that is greater than the atmospheric pressure.

Machines having enclosures with controlled atmosphere, by adapting the pressure inside the sealed enclosure, make it possible to limit and even nullify the difference in pressure between the inside and outside of the container being filled. This is particularly useful to allow the filling of containers made of thermoplastic material obtained by blow-molding, especially if they are manufactured just prior to being filled and are taken to the filling machine before their temperature has completely stabilized.

A purpose of the invention is to propose a new design of such a machine, and particularly a new design of fill enclosures to make it possible to decrease the manufacturing cost and the operating cost, and at the same time permit optimal operation of the machine with containers of variable size.

To that end, the invention proposes a filling machine of the type described above, characterized in that the machine has means to modify the volume of the closed enclosure.

According to other characteristics of the invention:

- the form of an interchangeable part, and the fill station is able to receive different bottom walls to change the volume of the closed enclosure;
- the opening and closing of the enclosure are achieved by the axial sliding of the side wall, the bottom wall remaining immobile;
- the axial position of the bottom wall is adjustable in order to change the volume of the closed enclosure;
- the bottom wall has a regulation port that opens into the enclosure and through which regulation port the atmosphere of the enclosure is controlled;
- the bottom wall is mounted on a base on which it rests axially downward when the enclosure is open; the bottom wall is mounted on the base with an axial clearance, and when the enclosure is closed, the bottom wall is axially resting downward against one support surface connected to the side wall;
- the base of the bottom wall has an axial tubular shaft, the upper end of which has a base plate on which the bottom wall can rest when the enclosure is open; the regulation port of the bottom wall is connected by a regulation conduit 46 to a connector integral with the lower end of the tubular shaft, and the regulation conduit is received inside the tubular shaft;

- the regulation conduit is composed of a rigid pipe that is axially integral with the bottom wall and which is mounted with an axial clearance inside the tubular shaft;
- the side wall has a lower bearing that is slidably mounted on the tubular shaft to guide the side wall between a lower open position and an upper closed position;
- the fill station has locking means that allow the side wall to be axially locked on the fill head when the enclosure is closed;
- the side wall is composed of two parts which, when the enclosure is opened or closed, move in opposite directions; and
- the fill station has means for supporting the container that are movable between at least a loading position and a fill position in which the interior of the container is isolated from the interior of the enclosure.

Other characteristics and advantages of the invention will appear from the detailed description that follows, as well as from the appended drawings in which.

Figure 1:
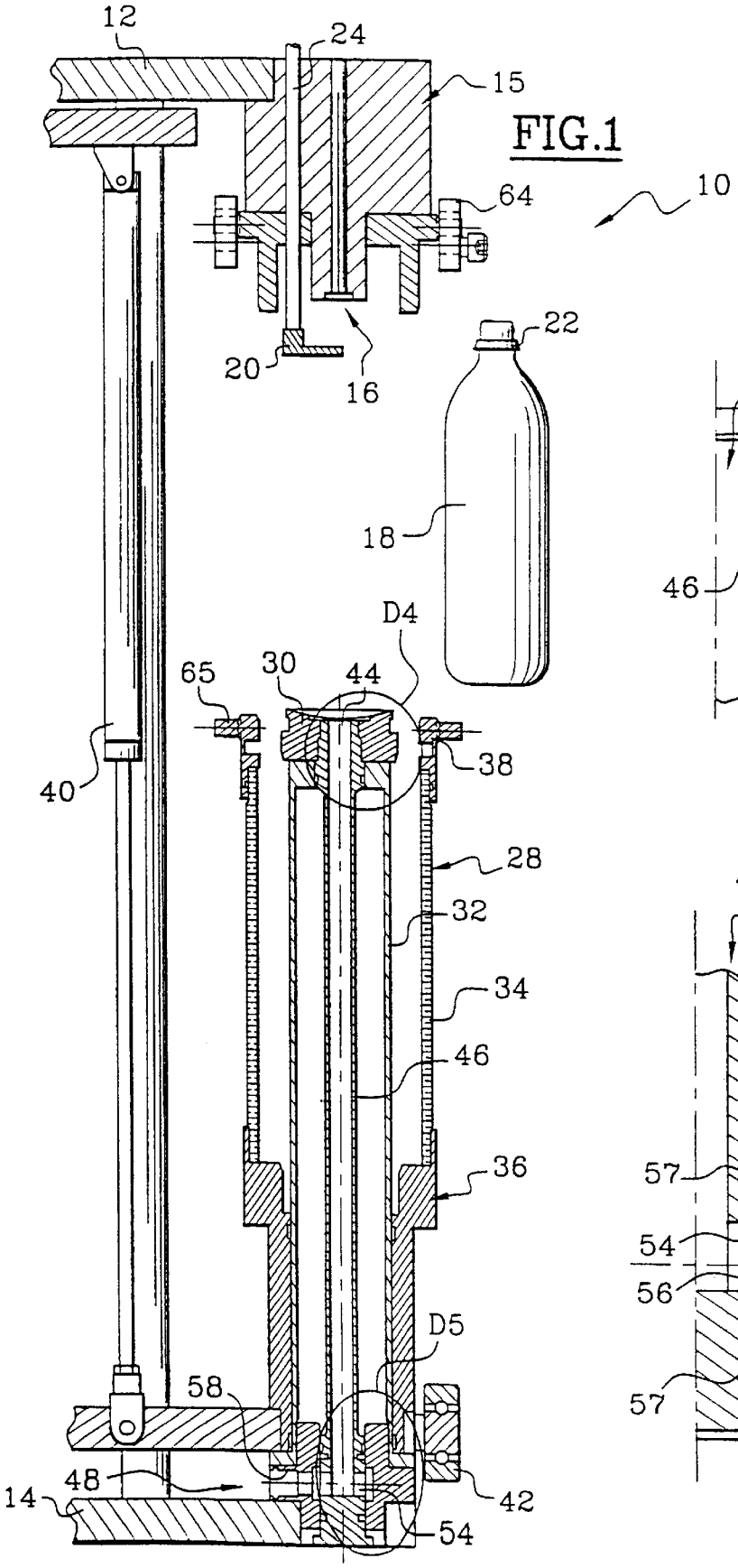
FIGS. 1 to 3 are diagrammatic views in axial cross section of a first form of embodiment of a fill station of a machine according to the invention, the fill station being represented successively in the position of loading/unloading the container, in the position of emptying the enclosure, and in the fill position.

Illustrated in FIGS. 1 to 8 is a first form of embodiment of a filling machine according to the invention.

More precisely, these Figures represent a fill station 10 of a machine that can have a large number of fill stations mounted on a rotary carrousel. For greater clarity of the description, the axis of rotation of the carrousel will be considered to be vertical and the containers will be considered to be filled in the vertical position.

In the example illustrated, the carrousel has an upper frame 12 and a lower frame 14. The upper frame 12 supports a fill head 15 of the station 10 concerned. In particular, this head 15 has a fill nozzle 16, illustrated only sketchily here, and which is intended to deliver a specific quantity of product into a container 18 that is taken beneath the nozzle 16. The dosing of the product can be by volume, flow rate or weight. Dosage can also be determined by detecting the fill level of the container 18.

It can be seen in the Figures that the container is intended to be held beneath the nozzle 16 by gripping means that are placed at the fill head 15, said gripping means being composed of a fork 20 capable of gripping the container 18 below a collar 22 situated at the base of its neck. To be sure, the machine according to the invention is particularly suitable for filling bottles made of thermoplastic material, such as polyethylene terephtalate (PET).

Figure 2:
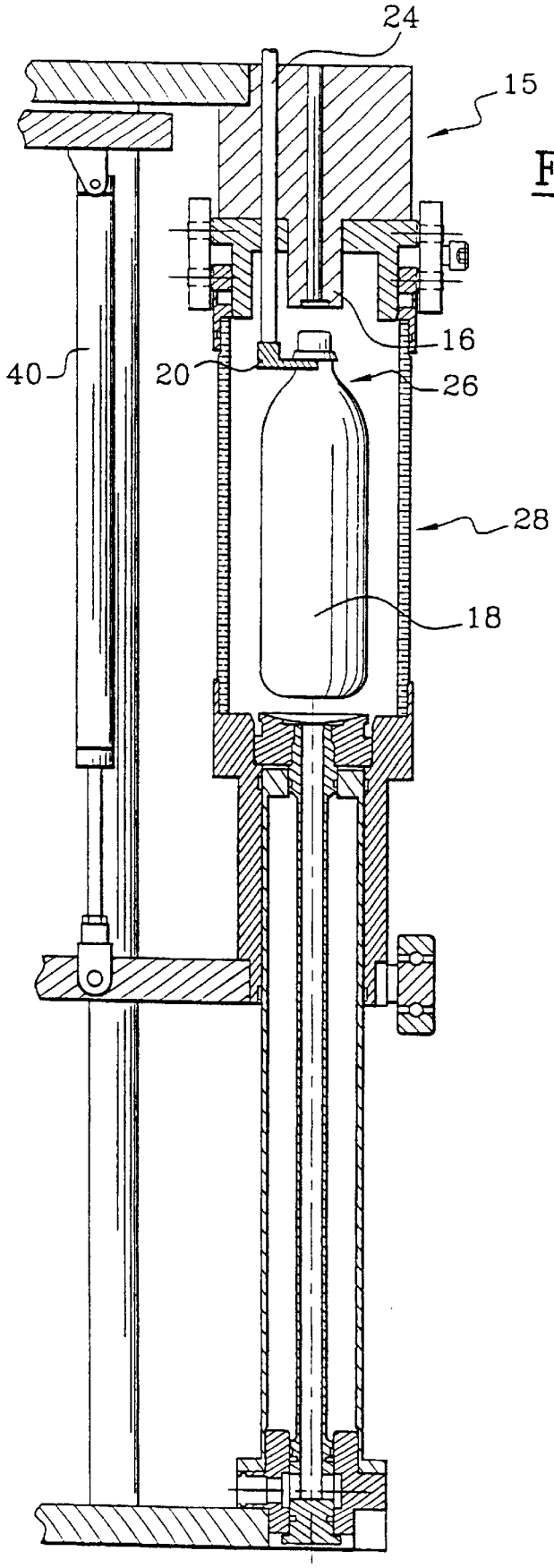
Figure 3:
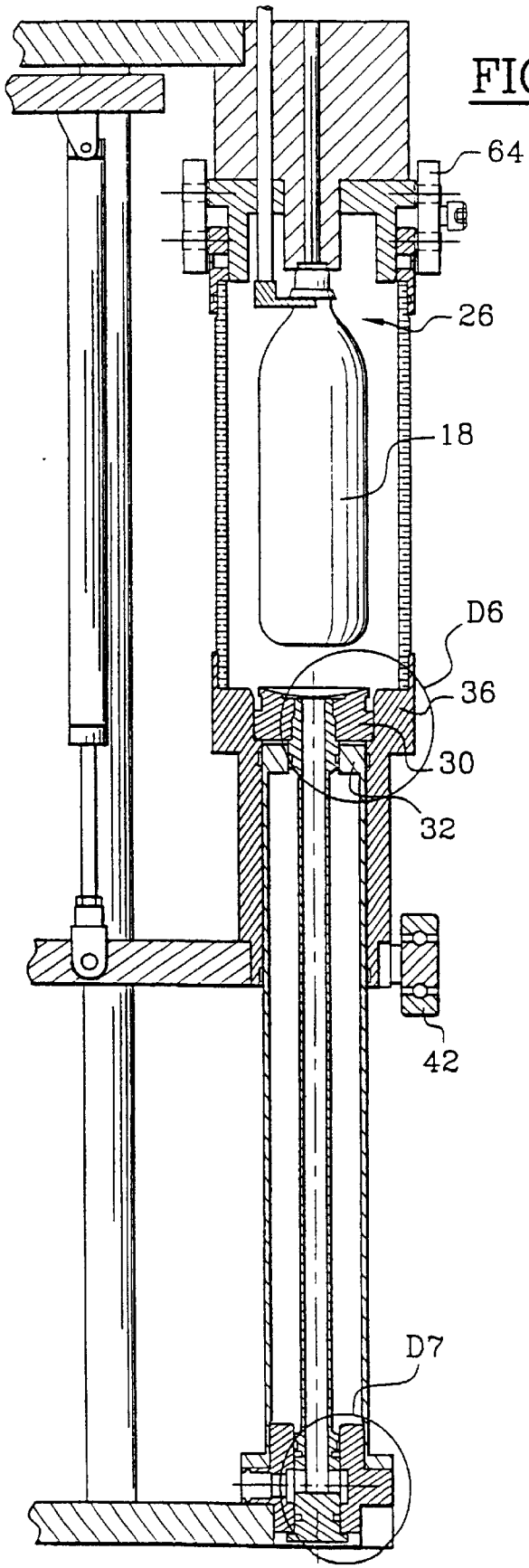

The fork 20 is mounted at the lower end of a rod 24 which slides vertically in the fill head 15 between a lower position for loading or discharging the container 18, illustrated in FIGS. 1 and 2, and an upper filling position illustrated in FIG. 3. In the lower position, the neck is released from the nozzle 16 while, in the upper position, the neck of the container 18 is pressed against the fill nozzle 16.

The fill station 10 is of the type in which the container 18 is placed in a sealed enclosure 26 during filling. The purpose of this arrangement is to be able to control the atmosphere inside and outside the container 18, both with respect to the composition of the gas as well as to the pressure of this gas.

As can be seen in FIG. 3, the enclosure 26 is delimited by a cylindrical side wall 28 with vertical axis, and at its two ends by the fill head 15 on the one hand, and by a bottom wall 30 on the other.

In order to allow the bottle 18 to be loaded into and removed from the enclosure 26, said enclosure must be opened. According to this first form of embodiment of the invention, the opening and closing of the enclosure are achieved by the vertical sliding of the side wall 28, the bottom wall 30 remaining appreciably fixed.

It can also be seen that the bottom wall 30 is mounted at the upper end of a column 32 which extends vertically along the axis A1 of the station 10 from the lower frame 14. As will be explained further on, in this first form of embodiment of the invention, the bottom wall 30 is mounted on the column 32 with a slight axial clearance.

The side wall 28 is composed of an axial tube 34 and two lower and upper ferrules 36, 38 that are connected to each other by tie rods (not represented) in such a way that the tube 34 is axially compressed between the two ferrules. Because of this construction, the tube 34 can be produced from a transparent materials such as glass, methyl polymethacrylate (PMMA) or a polycarbonate.

The lower ferrule 36 has a guide bearing that slides axially on the cylindrical outer face of the column 32. Moreover, it is connected to a cylinder 40, which is arranged parallel to the axis of the fill station and which can thus control the side wall 28 between a closed upper position of the enclosure 26 and a lower position in which the enclosure 26 is open to allow the container to be loaded or removed.

Obviously, means are provided to ensure the seal between the lower ferrule 36 and the column 32 on the one hand, and between the upper ferrule 38 and the fill head 15 on the other hand, because in the upper position of the wall, the upper ferrule 38 comes in contact with the head 15.

It will be noted that the lower ferrule 36 has a roller 42 that is intended to cooperate with a cam groove (not represented) placed along the circular path of the fill station 10 when it is driven in rotation with the carrousel. The cam-and-roller system makes it possible to better control the vertical movements of the side wall 28 depending on the angular position of the station 10 around the axis of the carrousel, the cylinder 40 being used only to provide the force required for the movement.

According to another characteristic of this form of embodiment, the control of the atmosphere inside the enclosure 26 is accomplished through the bottom wall 30. Indeed, this control is done by connecting the interior of the enclosure 26 either to vacuum systems or to sources of compressed gas. To do this, the bottom wall 30 has a regulation port 44 that is connected by a regulation conduit 46 to a connector 48 which is integral with the lower frame 14. In this instance, the connector 48 is placed near the lower end of the column 32.

In the example illustrated, the conduit 46 is accomplished in the form of a rigid tube and it is received inside the column 32, which is tubular. The upper end of the conduit is engaged in the regulation port 44 of the bottom wall 30 in order to connect with the enclosure 26. The conduit 46 and the bottom wall 30 are connected to each other in a way that on the one hand is sealed, and on the other hand so that the conduit 46 is axially integral with the bottom wall 30. To this end, the conduit is mounted inside the internal bore of the column 32 so as to be axially slidable, while being radially guided along the axis A1. Thus, the interior of the upper end of the column 32 forms a guide bearing 50 of the upper end of the conduit 46. In the same way, a lower base 52, which attaches the column 32 to the lower frame 14, is equipped so as to form a guide bearing for the lower end of the conduit 46.

As can be seen in FIGS. 1 to 3, the lower end of the conduit 46 is axially closed but is provided with radial bores 54 that connect the interior of the conduit with a ring-shaped groove 56 cut in the bearing portion of the base 52. Sealed areas 57 between the base 52 and the conduit 46 are provided axially on either side of the groove 56. The axial height of the groove 56 is such that the bores 54 of the conduit 46 remain facing the groove regardless of the axial position of the conduit. Indeed, it can be seen that it only moves a little. Of course, the base 52 has a radial orifice 58 that connects the groove 56 to the exterior and forms the connector 48.

Due to the rigidity of the bottom wall 30, it is easy to connect the regulation port to various sources of pressure or vacuum without the need for flexible tubing, the use of which is always awkward when a long path of movement is required, such as in the case of the movable side wall 28.

Moreover, it is advantageous to control the atmosphere through the bottom wall 30, and not through the fill head 15, because this allows the space at the head 15 to be kept free. In addition, when the enclosure 26 is connected to a vacuum source to evacuate the enclosure, gravity is of benefit in evacuating any particles or dust.

Finally, the regulation port 44 will act as a drain if a liquid fills the enclosure. In particular, this could occur if the machine has a system called "clean in place" by which a cleaning liquid is circulated in the enclosures in the closed position, in the absence of containers.

Following is a simplified explanation of the filling of a container, in the case of drawing off under vacuum, on a machine according to the invention. During the revolution of the carrousel, the fill post concerned is first located in a loading area at which it arrives with the enclosure 26 open, as illustrated in FIG. 1. Transfer means then place an empty container, which is hooked on the fork 20, into the enclosure 26. As can be seen in FIG. 2, the enclosure 26 is closed and the air contained therein is evacuated, both inside and outside the container. According to the illustration in FIG. 3, the neck of the container 18 is then pressed against the fill nozzle 16 by the rising of the rod 24 to which the fork 20 is attached, in order to sealably separate the interior of the container from the rest of the enclosure 26. The filling can then be done, after which the fill station reaches a discharge area in which the enclosure 26 is opened to allow the full container to be removed. The fill station then again reaches the loading area.

According to one aspect of the invention that is specific to this first form of embodiment, and in spite of the use of a bottom 30 that is appreciably fixed, the use of the enclosure 26 with a pressure that is greater than the atmospheric pressure does not cause axial forces that would tend to separate the two frames 12, 14 from each other.

Figure 4:
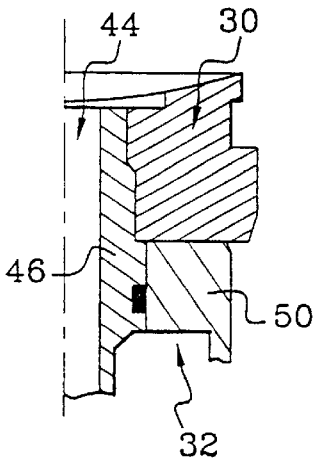
FIGS. 4 and 5 are larger views of details D4 and D5 of FIG. 1.
Figure 5:
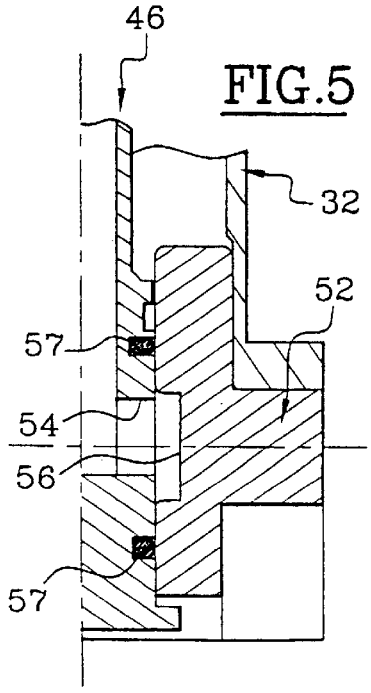

In fact, FIGS. 1, 4 and 5 show that when the side wall 28 is in the lower position, the bottom wall 30 presses axially downward against the upper end 50 of the column 32. On the contrary, just before reaching the upper position, the lower ferrule 36 of the side wall 28 comes to rest, by one annular face 60 facing upward, against a lower annular face 62 of the bottom wall 30. In continuing its rise to the upper position, the side wall 28 draws with it the bottom wall 30 which is then lifted off of the column 32. Of course, this does not need to be lifted far: a displacement of from one to five millimeters is sufficient.

Figure 6:
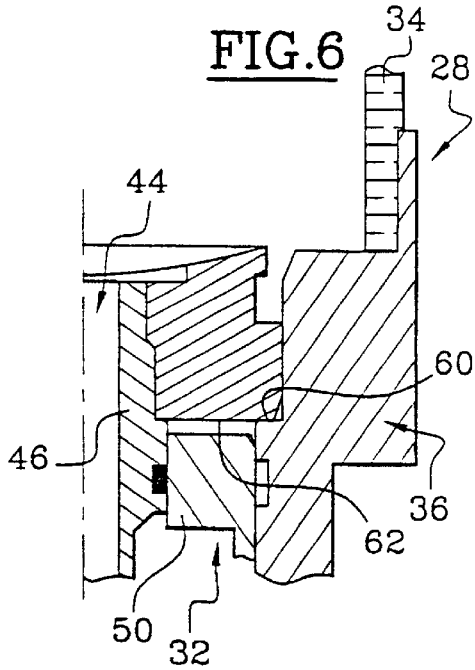
FIGS. 6 and 7 are larger views of details D6 and D7 of FIG. 3.
Figure 7:
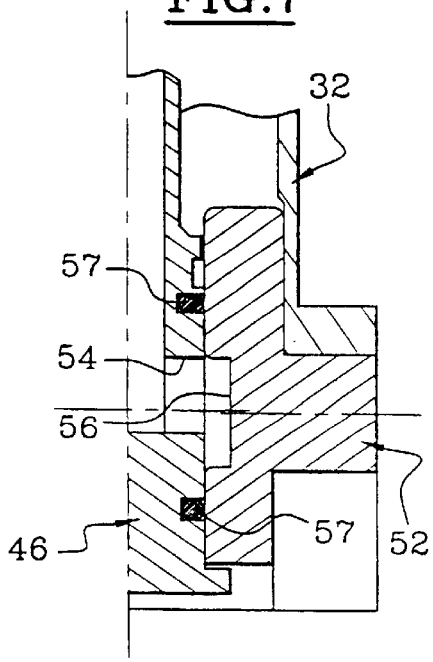

Once the side wall 28 is in the upper position, as illustrated in FIGS. 3, 6 and 7, locking hooks 64 of the head 15 cooperate with the pins 65 of the upper ferrule 38 to axially secure the side wall 28, and thus the bottom 30, on the fill head 15. In this way, even when there is an overpressure in the enclosure 26, the action of the pressure forces on the bottom wall 30—in this instance exerted vertically downward—is not passed on to the lower frame 14. The upper frame 12 is not stressed by the forces of pressure exerted in the chamber 26 because they cancel each other out. Thus, the structure of the machine has no need to be particularly reinforced.

By comparing FIGS. 5 and 7, it can be seen that, the conduit 46 being integral with the bottom wall 30, its lower end is moved with respect to the base 52. However, because this movement is very small, the bores 54 of the conduit 46 remain facing the groove 56 in order to keep the enclosure 26 connected to the connector 48.

Figure 8:
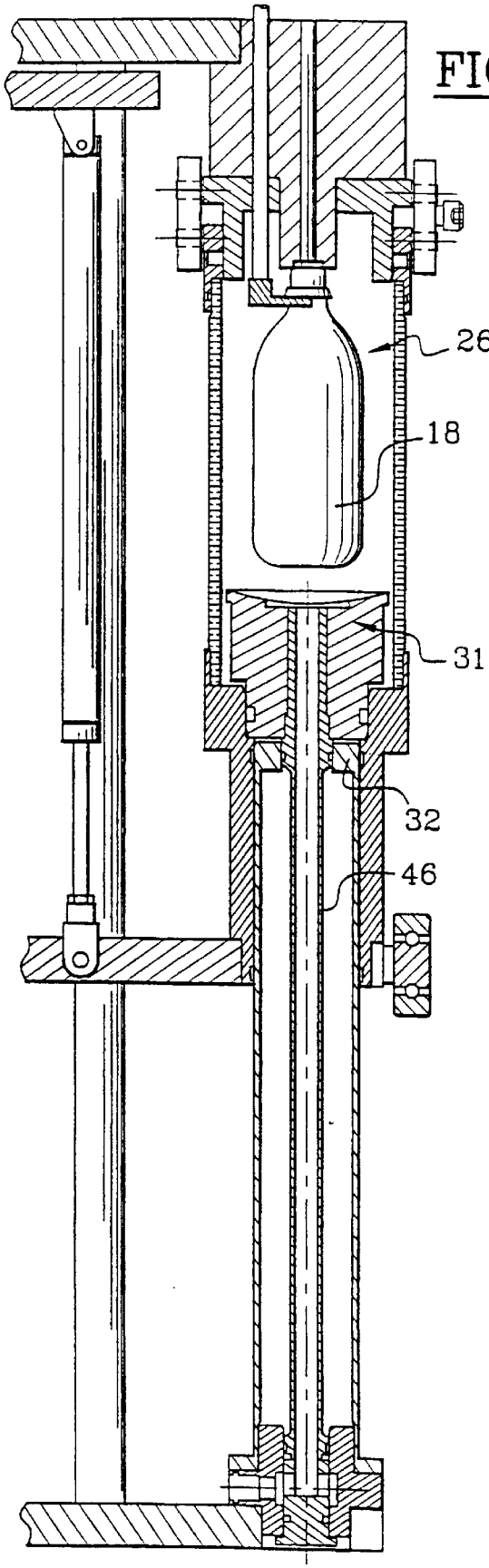
FIG. 8 is a view similar to that in FIG. 3 in which the fill station can be seen with a bottom wall of the enclosure suitable for filling small format containers.

FIG. 8 illustrates a particularly simple way of reducing the internal volume of the enclosure 26 when the machine is to be used to fill small containers.

In this case, the bottom wall as illustrated in FIGS. 1 to 3 could be replaced by a bottom wall 31 having a much larger volume. Thus, without changing any other part of the machine, the internal volume of the enclosure 26 is reduced. In this way, when overpressure is used for the fill, the amount of gas to furnish to the part of the enclosure 26 outside of the container can be greatly reduced. When the fill is done under vacuum, the pumping time—that is, the time required to change from normal atmospheric pressure to the fill pressure—can be reduced. Of course, quick-mounting means will preferably be provided between the bottom wall 30, 31 and the feed conduit 46 in order to be able quickly to change the configuration of the machine based on the volume of the container to be filled.

Obviously, this means of reducing the volume could also be applied for a machine of the type described in document WO-99/05061, in which, for each enclosure, the bottom wall is integral with the side wall.

Figure 9:
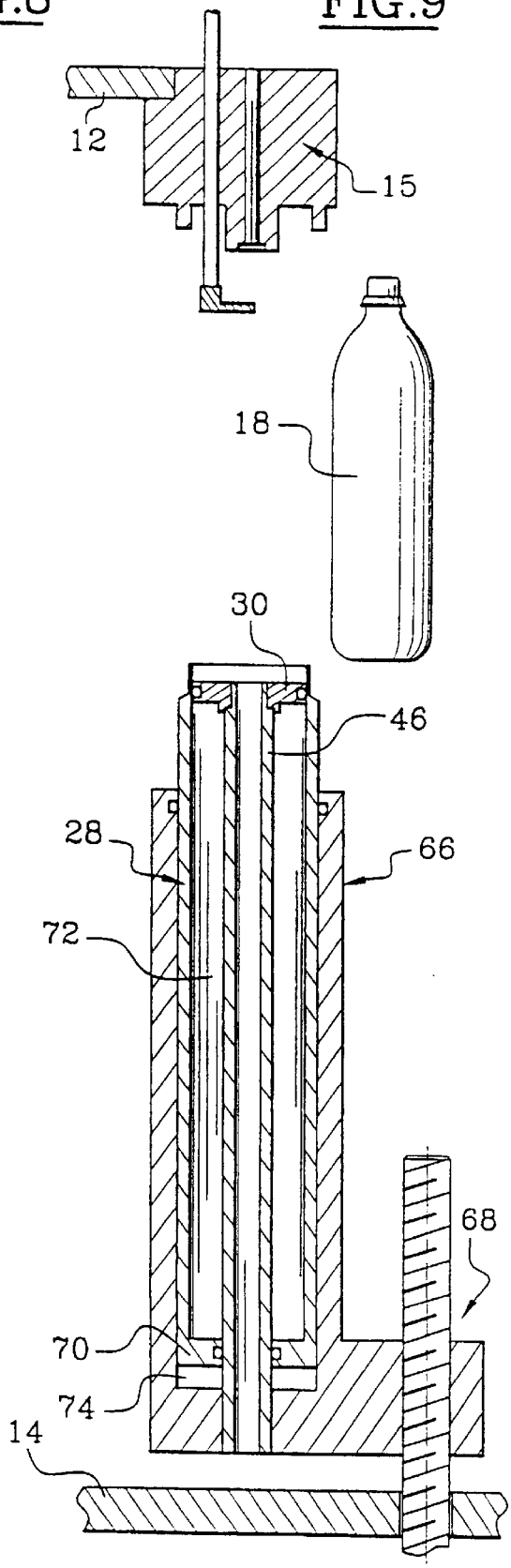
FIGS. 9 and 10 are views similar to those in FIGS. 1 and 3, illustrating a second form of embodiment of the invention, with a bottom wall, the axial position of which is adjustable.
Figure 10:
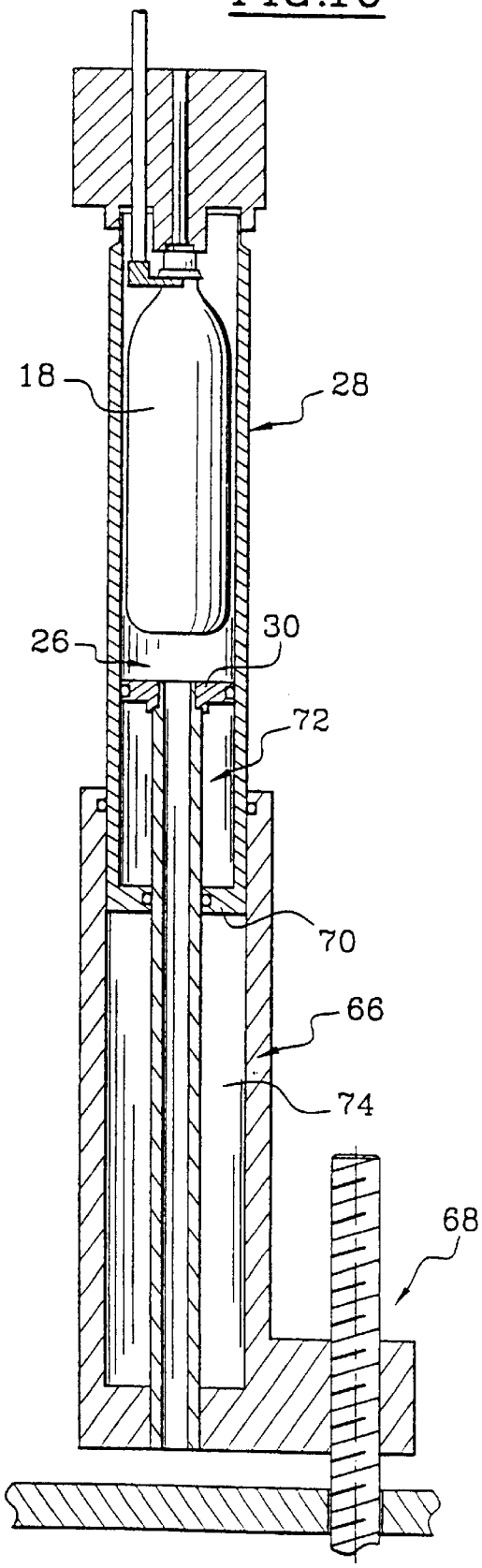
Figure 11:
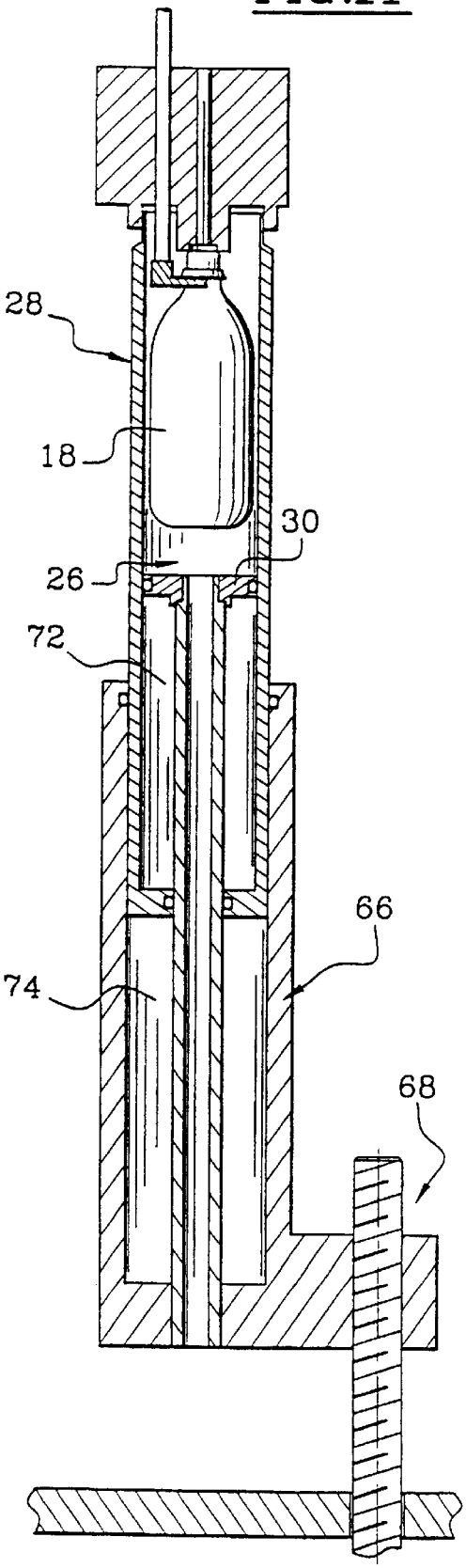
FIG. 11 is a view of the second form of embodiment of the invention, illustrating the fill station adjusted for filling a container of small volume.

FIGS. 9 to 11 illustrate a second form of embodiment of the invention, which can be implemented, for example, for filling under a pressure that is lower than the atmospheric pressure or under a slight overpressure. It can also be implemented in cases where the filling must be done at atmospheric pressure but in a gaseous environment of special composition.

In these cases, there is no problem with separation of the upper and lower frames 12, 14, and it is therefore possible to attach the bottom wall 30 of the enclosure 26 rigidly to the lower frame 14. Also, it was decided to attach the bottom wall 30 and the conduit 46 to a base 66, the axial position of which, with respect to the lower frame 14, is adjustable, for example by a screw/nut system 68. In the example illustrated, the base 66 is in the form of a tubular sleeve in which the side wall 28 of the enclosure 26 is guided axially. Of course, the feed conduit 46, through which the atmosphere of the enclosure 26 is controlled, extends coaxially at the center of the base/side wall assembly, and it opens out downward through a closed lower end of the base 66. In construction, the base 66 and the bottom wall 30 always occupy the same relative position. Also, by comparing FIGS. 10 and 11 it will be seen that by moving the base 66 with respect to the lower frame 12, the bottom wall 30 is brought more or less close to the fill head 15, which makes it possible to vary the volume of the enclosure 26.

This form of embodiment is particularly attractive because it allows the volume to be changed very quickly, in a single operation for all of the machine's fill stations. Moreover, this operation can be remotely controlled if working directly on the machine is to be avoided, for example when the machine is operating in a sterile environment or reduced contamination.

In this form of embodiment, it will be noted that the side wall 28 is not subject to any axial force when the enclosure 26 is placed under pressure. It is therefore not necessary to provide special means for locking the side wall in the upper position.

In addition, it can be seen that the lower end of the side wall 28, which is permanently inserted in the sleeve forming the base 66, has a lower transverse wall 70 through which a conduit 46 passes in a sealed manner. In the same way, the bottom wall 30 is in sealed contact with the side wall 28. Thus, the transverse wall 70 delimits, between the bottom wall 30 and the lower end of the base 66, two annular chambers 72, 74 with variable volume. These chambers can thus be used like a double-acting cylinder to control the movements of the side wall 28, the transverse wall 70 acting as the piston.

Figure 12:
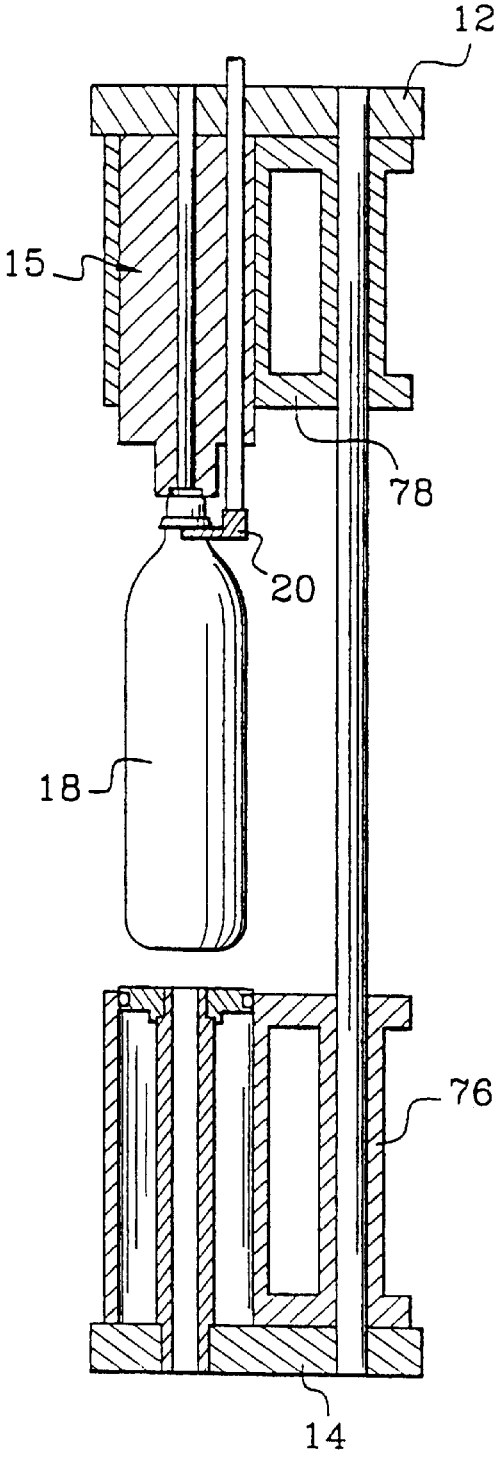
FIGS. 12 and 13, are views similar to those in FIGS. 1 and 3, illustrating a third form of embodiment of the invention.
Figure 13:
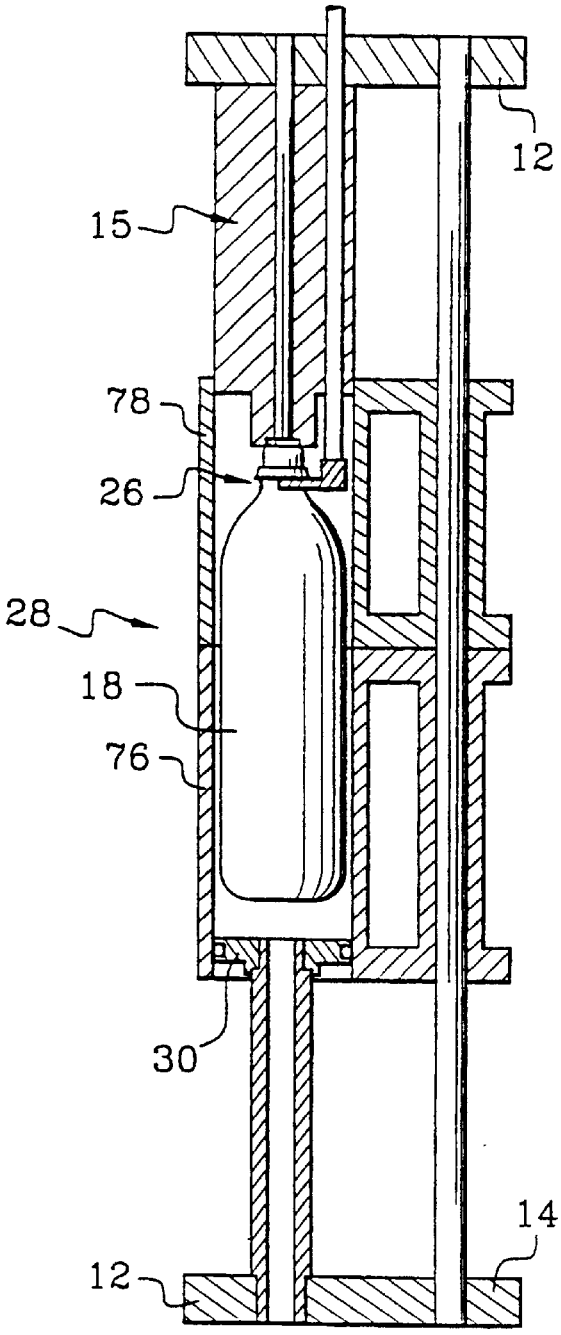

FIGS. 12 and 13 illustrate a variant form of embodiment of the invention in which the side wall 28 is divided into two parts, upper and lower. With respect to the closed position illustrated in FIG. 13, it can be seen that the opening of the enclosure 26 is obtained by retracting a lower part 76 of the side wall downward, and an upper part 78 upward. Thus, the lower part 76 is retracted around the bottom wall 30, which is fixed. The upper part 78 is retracted around the fill head 15. With this construction, the travel of each of these parts 76, 78 of the side wall 28 is reduced and the axial amount of space required by the unit is better distributed above and below the fill station.

What is claimed is:

1. A machine for filling containers, the machine comprising at least one fill station having a sealed enclosure intended to receive a container to be filled, the enclosure opening to allow the container to be loaded or removed, and the enclosure closing to allow the atmosphere within the enclosure to be controlled while the container is being filled, wherein the enclosure comprises an upper head having a fill nozzle and means to support the container, a substantially cylindrical side wall and a bottom wall, wherein the bottom wall is made in the form of an interchangeable part, and the fill station is able to receive different bottom walls to change the volume of the enclosure when closed.

2. The filling machine according to claim 1, wherein the means for supporting the container are movable between at least a loading position and a fill position in which the interior of the container is isolated from the interior of the enclosure.

3. The filling machine according to claim 1, wherein the side wall slides axially during the opening and closing of the enclosure, and the bottom wall remains immobile.

4. The filling machine according to claim 3, wherein the axial position of the bottom wall is adjusted to change the volume of the closed enclosure.

5. The filling machine according to claim 3, wherein the bottom wall has a regulation port that opens into the enclosure and through which regulation port the atmosphere of the enclosure is controlled.

6. The filling machine according to claim 3, wherein the bottom wall is mounted on a base on which it rests axially downward when the enclosure is open, and the bottom wall is mounted on the base with an axial clearance, and when the enclosure is closed, the bottom wall is axially resting downward against one support surface connected to the side wall.

7. The filling machine according to claim 6, wherein the base of the bottom wall has an axial tubular shaft, the upper end of which has a base plate on which the bottom wall can rest when the enclosure is open, the regulation port of the bottom wall is connected by a regulation conduit to a connector integral with the lower end of the tubular shaft, and the regulation conduit is received inside the tubular shaft.

8. The filling machine according to claim 7, wherein the regulation conduit is composed of a rigid pipe that is axially integral with the bottom wall and which is mounted with an axial clearance inside the tubular shaft.

9. The filling machine according to claim 7, wherein the side wall has a lower bearing that is slidably mounted on the tubular shaft to guide the side wall between a lower open position and an upper closed position.

10. The filling machine according to claim 1, wherein the fill station has locking means that allow the side wall to be axially locked on the fill head when the enclosure is closed.

11. A machine for filling containers, the machine comprising at least one fill station having a sealed enclosure intended to receive a container to be filled, the enclosure opening to allow the container to be loaded or removed, and the enclosure closing to allow the atmosphere within the enclosure to be controlled while the container is being filled, wherein the enclosure comprises an upper head having a fill nozzle and means to support the container, a bottom wall and a substantially cylindrical side wall composed of two portions which, when the enclosure is opened or closed, move axially in opposition directions, wherein the machine further comprises means for changing the volume of the enclosure when closed.

12. The filling machine according to claim 11, wherein the bottom wall remains immobile during the opening and closing of the enclosure.

13. The filling machine according to claim 11 wherein the means for supporting the container are movable between at least a loading position and a fill position in which the interior of the container is isolated from the interior of the enclosure.

14. The filling machine according to claim 11 wherein the bottom wall is made in the form of an interchangeable part, and the fill station is able to receive different bottom walls to change the volume of the closed enclosure.

* * * * *